US007385190B2

(12) United States Patent
Fischer et al.

(10) Patent No.: US 7,385,190 B2
(45) Date of Patent: Jun. 10, 2008

(54) REFERENCE MASS INTRODUCTION VIA A CAPILLARY

(75) Inventors: Steven Fischer, Hayward, CA (US); Charles W. Russ, IV, Sunnyvale, CA (US); William Barry, Sunnyvale, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 248 days.

(21) Appl. No.: 11/280,710

(22) Filed: Nov. 16, 2005

(65) Prior Publication Data

US 2007/0114386 A1 May 24, 2007

(51) Int. Cl.
*H01J 49/10* (2006.01)

(52) U.S. Cl. ..... 250/288; 250/252.1

(58) Field of Classification Search ..... 250/288, 250/252.1

See application file for complete search history.

(56) References Cited

U.S. PATENT DOCUMENTS 5,703,360 A * 12/1997 Fischer et al. ..... 250/288
2006/0054805 A1* 3/2006 Flanagan et al. ..... 250/288

* cited by examiner

*Primary Examiner*—Kiet T. Nguyen

(57) ABSTRACT

A mass calibration apparatus for a mass spectrometer includes a capillary, an analyte ion source coupled to the capillary at a first point, a reference mass ion source coupled to the capillary at a second point, downstream from the first point and a mass analyzer coupled to the capillary at a third point downstream from the first and second points. The reference mass ion source may be coupled to the capillary via a tee junction. The reference mass ion source includes a chamber, an ionization device situated within the chamber and one or more reference mass sources that are situated internally within the chamber or are situated external to and coupled to the chamber.

16 Claims, 6 Drawing Sheets

REFERENCE MASS INTRODUCTION VIA A CAPILLARY

FIELD OF THE INVENTION

The present invention relates to mass spectroscopy systems, and more particularly, but without limitation, relates to an apparatus and method for introducing reference masses to a mass spectrometer via a capillary.

BACKGROUND INFORMATION

In mass spectrometry, it is often useful to calibrate spectrometer instruments using a reference mass, which, since its mass is accurately known, can be used to compensate for drifting of the mass assignments. Reference masses are typically introduced into the ion source section where they can sometimes interfere with analyte ion production or otherwise complicate the design and ease of use of the analyte ion source. For example, in electrospray (ESI and nano ESI) sources, a dual sprayer inlet is used, requiring extra components and constraining interchangeability of the source modules. With regard to APCI, APPI and multimode sources, reference masses are typically added directly to the analyte stream which can result in signal suppression and precipitation. In AP-MALDI sources, ions are spiked into the matrix. This approach suffers from ion suppression of the reference masses or analytes embedded in the matrix. Furthermore, with regard generally to all techniques of introducing of reference masses at the analyte ion source stage, additional instruction for customers and additional development for manufacturers is often required for proper operation.

SUMMARY OF THE INVENTION

The present invention in one aspect provides a mass calibration apparatus that comprises a capillary, an analyte ion source coupled to the capillary at a first point, a reference mass ion source coupled to the capillary at a second point, downstream from the first point, and a mass analyzer coupled to the capillary at a third point downstream from the first and second points. The reference mass ion source may be coupled to the capillary via a tee junction. The reference mass ion source may include a chamber, an ionization device situated within the chamber and in various embodiments, one or more reference mass sources that may be situated internally within the chamber or externally to and coupled to the chamber.

In another aspect the present invention provides an ion source for a mass spectrometer that comprises an analyte ion source chamber having a first output for delivery of analyte ions, a capillary having first, second and third points, the first point being upstream of the second point, and the second point being upstream of the third point. The capillary is coupled to the output of the analyte ion source chamber at the first point, and a reference mass ion source having a second output for delivery of reference mass ions is coupled to the capillary at the second point. The analyte ions and reference mass ions are joined in the capillary downstream from the second point for output at the third point.

In yet another aspect, the present invention provides a mass spectrometer that comprises a calibrated ion source that includes a capillary, an analyte ion source coupled to the capillary at a first point along the capillary, and a reference mass ion source coupled to the capillary at a second point, downstream from the first point. The mass spectrometer also includes a mass analyzer coupled to the capillary downstream from the second point and a detector situated downstream from and coupled to the mass analyzer.

In a further aspect, the present invention provides a method of mass calibration of analyte ions with reference mass ions in a mass spectrometer that includes an ion source, a mass analyzer, and a capillary coupling the ion source and the mass analyzer. The method comprises ionizing reference mass ions in a chamber separate from the ion source and coupled to the capillary and introducing reference mass ions into the capillary at a junction of the capillary situated between the ion source and the mass analyzer.

DETAILED DESCRIPTION

Before describing the present invention in detail, it must be noted that, as used in this specification and the appended claims, the singular forms "a," "an," and "the" include plural referents unless the context clearly dictates otherwise. Thus, for example, reference to "a capillary" includes more than one "capillary". Reference to an "electrospray ionization source" or an "atmospheric pressure ionization source" includes more than one "electrospray ionization source" or "atmospheric pressure ionization source". In describing and claiming the present invention, the following terminology will be used in accordance with the definitions set out below.

The term "adjacent" means near, next to or adjoining. Something adjacent may also be in contact with another component, surround (i.e. be concentric with) the other component, be spaced from the other component or contain a portion of the other component.

The term "corona needle" refers to any conduit, needle, object, or device that may be used to create a corona discharge.

The term "analyte ion source" or "ion source" refers to any source that produces analyte ions.

The term "reference mass ion source" refers to any source that produces reference mass ions.

The term "electrospray ionization source" refers to a nebulizer and associated parts for producing electrospray ions. The nebulizer may or may not be at ground potential. The term should also be broadly construed to comprise an apparatus or device such as a tube with an electrode that can discharge charged particles that are similar or identical to those ions produced using electrospray ionization techniques well known in the art.

An "ultraviolet photon source" is defined to include a source of vacuum ultraviolet radiation. In this context, the ultraviolet radiation spectrum is defined as ranging from 200 to 400 nanometers in wavelength and the vacuum ultraviolet spectrum occupies a sub-range of the ultraviolet wavelengths from 200 to 280 nanometers.

The invention is described with reference to the figures. The figures are not to scale, and in particular, certain dimensions may be exaggerated for clarity of presentation.

Figure 1:
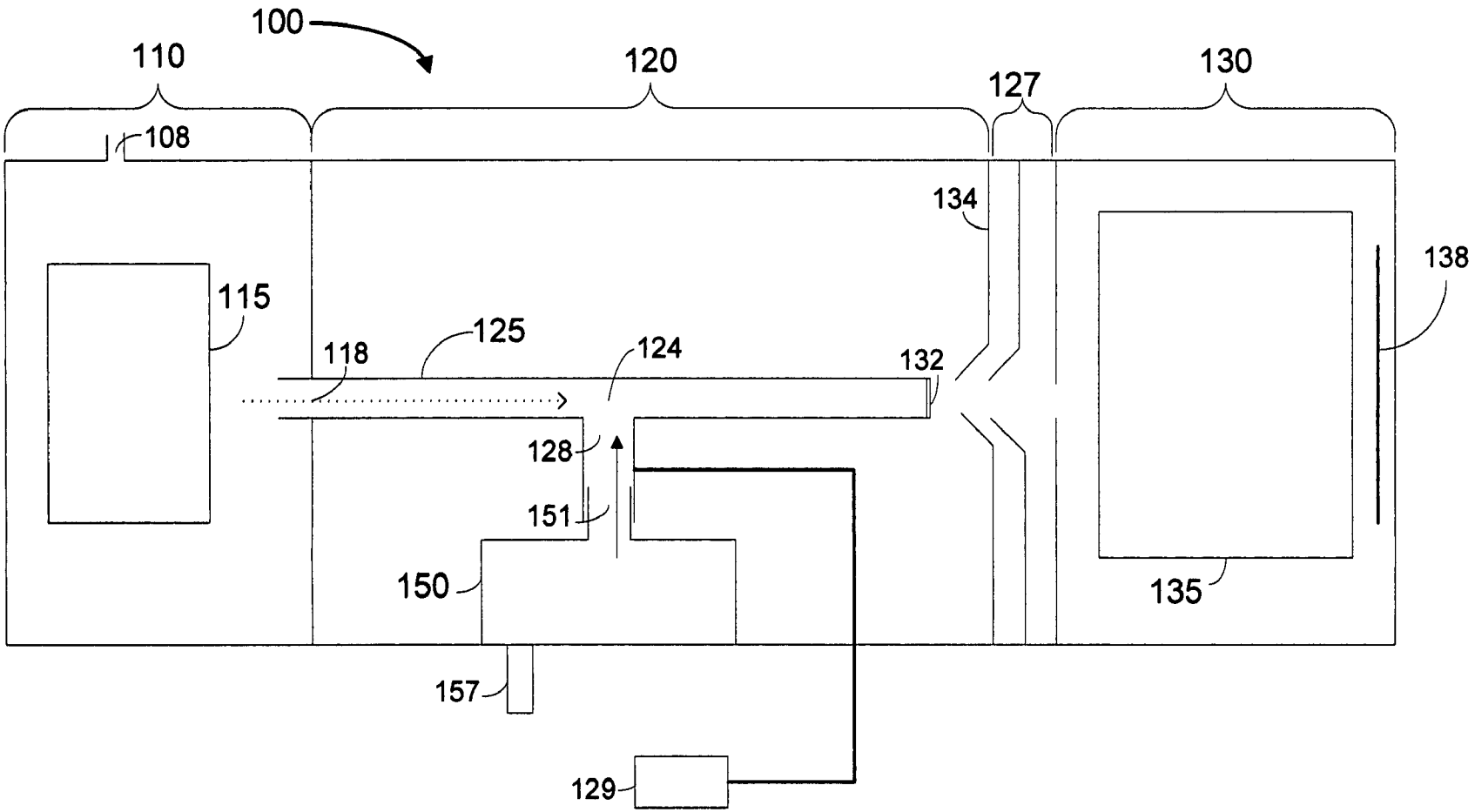
FIG. 1 illustrates a mass spectrometer that enables reference mass ions to be introduced internally via a capillary according to an embodiment of the present invention.

FIG. 1 schematically illustrates a mass spectrometer 100 that enables reference mass ions to be introduced internally via a capillary. Initially, analyte samples are introduced to an ion source section 110 via an inlet 108 usually in the form of a fluid stream in which the analytes are mixed with a solvent. For this purpose, the inlet may be coupled to a liquid chromatography system such as an HPLC, a micro-LC, or a capillary electrophoresis instrument. Although only one inlet 108 is shown, the ion source 110 may include additional inlets for sample introduction.

The analyte sample fluid stream is then delivered through or exposed to one or more ionization devices 115. The analyte ion source 110 may be operated at or near atmospheric pressure, typically between 0.5 and 2 atmospheres, in which case, the ionization device 115 can comprise any of the atmospheric pressure ionization techniques known in the art including ESI, APCI, APPI, AP-MALDI, or any suitable combination of such devices in a multimode source. Upon exposure to the ionization device 115, a large portion of the analytes in the sample are ionized and thereby subject to electrostatic fields in the ion source that attract (or repel) the analyte ions towards an inlet 118 of a capillary 125 which carries the analyte ions downstream to the succeeding stages of the mass spectrometer. Before entering the capillary 125, the analyte ions may be heated to remove remnant solvent molecules.

The capillary 125 extends from the inlet 118 in the ion source section 110 through a transition section 120 of the mass spectrometer. The pressure along the length of the capillary 125 will be at pressures intermediate between atmospheric and high vacuum, in the range of 1 mtorr to near atmospheric, for example. The capillary 125 includes a second branch or inlet 128 along its length within the transition section 120 which may be oriented perpendicularly with respect to the axis of the capillary forming a "tee junction" 124. It is to be noted the inlet can also be oriented at other angles with respect to the capillary, and that the perpendicular tee arrangement represents merely one possible implementation of a capillary junction that may be used in the context of the present invention. The capillary 125 extends through the transition section 120 to an outlet 132 which leads to through skimmers 134 to one or more vacuum stages 127 and then to the mass analyzer section 130. The number of vacuum stages 127 shown (two) is merely exemplary and the number, and the prevailing pressure maintained in them will depend on the type of mass analyzer employed, and the corresponding manner in which the ions are conditioned, among other variables as known in the art. The vacuums stages may include one or more ion guides (not shown) for focusing the ions as they are transported towards the mass analyzer.

A reference mass ion source chamber 150 is positioned within (as shown) or is directly coupled to the transition section 120 via an outlet 151 that connects to the second inlet 128 of the capillary 125 so that reference mass ions from the source chamber can be delivered to the capillary through the tee junction 124. The reference mass ion source 150 may be operated at pressures higher than those prevailing in the capillary 125, such as at atmospheric or sub-atmospheric pressure (depending on the pressure along the length of the capillary 125), so that ions produced in the reference mass ion source are propelled by the pressure difference between the source and the capillary toward the junction 124. By this arrangement, when reference mass ions flow to the tee junction 124, they become entrained and merge in the downstream flow of analyte ions coming from the analyte ion source 110. A switchable power supply 129 may be coupled to the second inlet 128 (or to the outlet 151) so that a voltage level can be applied to this point for selecting reference mass ions of an appropriate polarity for entrance into and further transport down the capillary 125.

Both analyte ions and reference mass ions are transported through skimmers 134 via vacuum stages 127 to the mass analyzer section 130 where the analyte and reference mass ions are scanned and separated according to their respective m/z ratios. The mass analyzer 135 includes a detector 138 that produces a mass spectral signal for the analyte and reference mass ions that come into contact with it. The mass analyzer may include, for example and without limitation, a TOF (Time-Of-Flight), multipole (such as a quadrupole), FT-ICR (Fourier Transform—Ion Cyclotron Resonance), ion trap, orbitrap, magnetic sector or any combination of these devices in a tandem arrangement.

Figure 2A:
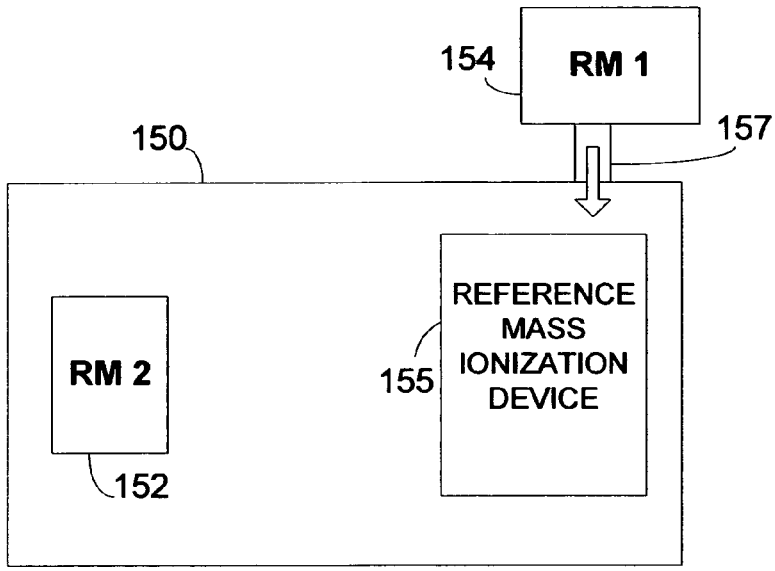
FIG. 2A illustrates an embodiment of a reference mass ion source according to the present invention in which one source of reference mass compounds is situated externally from a reference mass ion source chamber and another source is situated internally within the chamber.
Figure 2B:
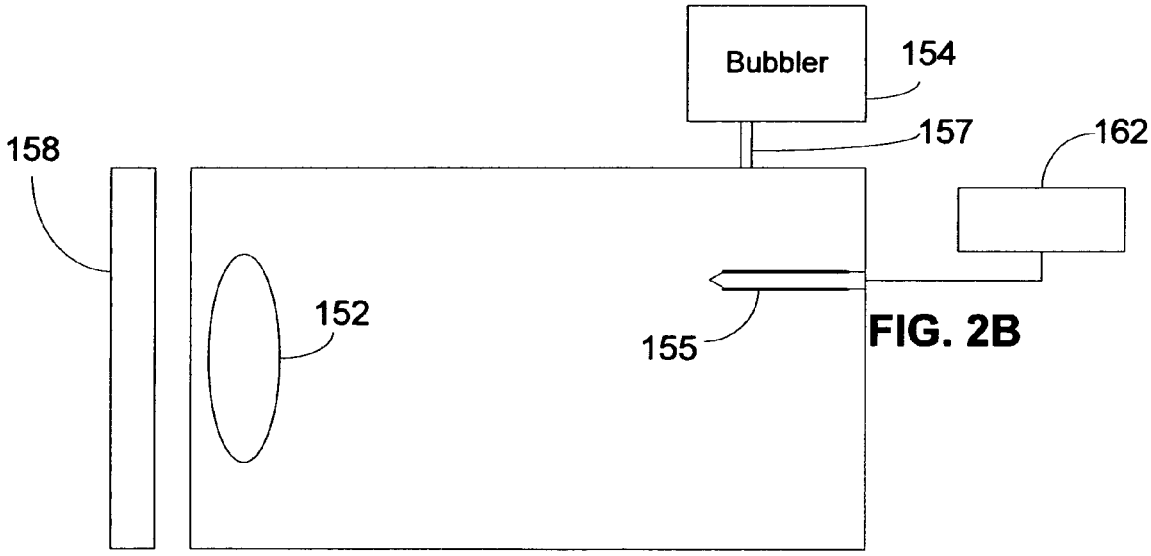
FIG. 2B illustrates an embodiment of the reference mass ion source according to FIG. 2A in which the external source of reference mass compounds is a bubbler, the internal source is heated and the ionization device is a corona needle.
Figure 2C:
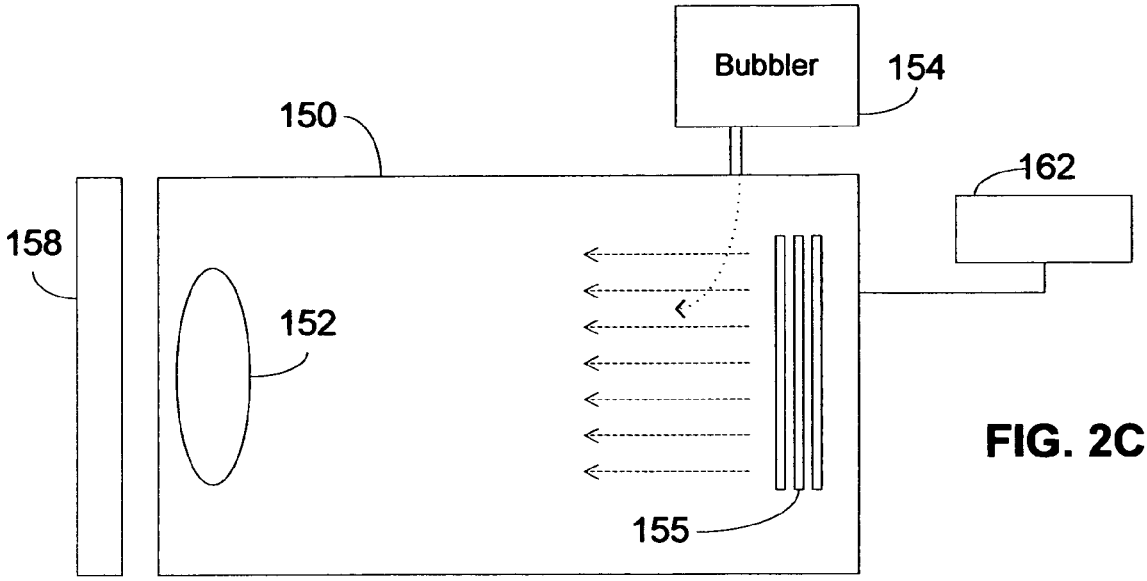
FIG. 2C illustrates an embodiment of the reference mass ion source according to FIG. 2B in which a photoionization source is used to ionize reference masses.

FIG. 2A illustrates a first example embodiment of a reference ion mass source according to the present invention. In this embodiment, the reference mass ion source 150 comprises a chamber that includes an inlet 157 for receiving a first group of reference masses (RM 1) emanating from an external source 154, while another group of reference masses (RM 2) is placed on a fixture 152 positioned internally within the chamber. Both groups of reference masses RM 1 and RM 2 may be provided in gaseous form. A reference mass ionization device 155 is also positioned within the chamber and is arranged so as to ionize both groups of reference masses RM 1 and RM 2 once vaporized. For example, as shown in FIG. 2B, which is a specific embodiment of the reference mass ion source arrangement illustrated in FIG. 2A, the external reference mass source 154 may be implemented using a bubbler that bubbles a carrier gas though a liquid that contains low mass reference compounds, while the internal reference mass source 152 may implemented using a heater 158 that evaporates or sublimates high mass reference compounds that are provided within the chamber in the form of a liquid, a solid or a crystalline matrix. The carrier gas that includes the low reference mass compounds mixes with the vaporized high reference mass compounds within the chamber and they are both exposed to the operation of the ionization device, which may be implemented using a corona needle 155, for example. The corona needle may be coupled to a separate power supply 162 for its operation. FIG. 2C illustrates an alternative embodiment in which a photoionization source 155, such as a vacuum ultraviolet (VUV) photon source (which may also be coupled to a separate power source) is used to ionize the reference mass compounds instead of a corona needle.

Figure 3A:
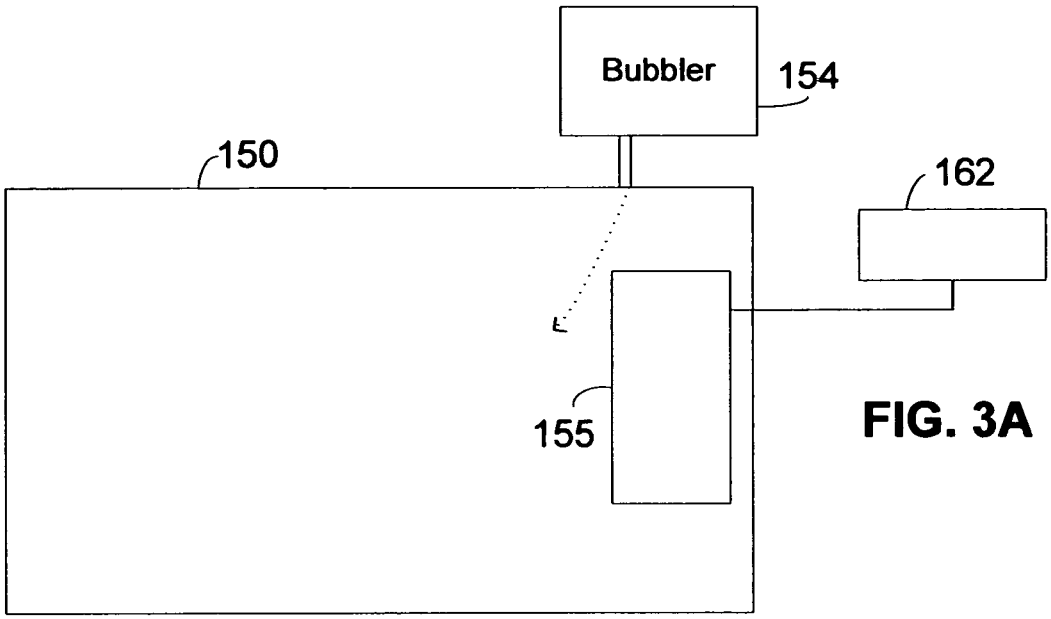
FIG. 3A illustrates a reference mass ion source according to an embodiment of the present invention in which there is a single source of reference masses situated externally from the reference mass ion source chamber.
Figure 3B:
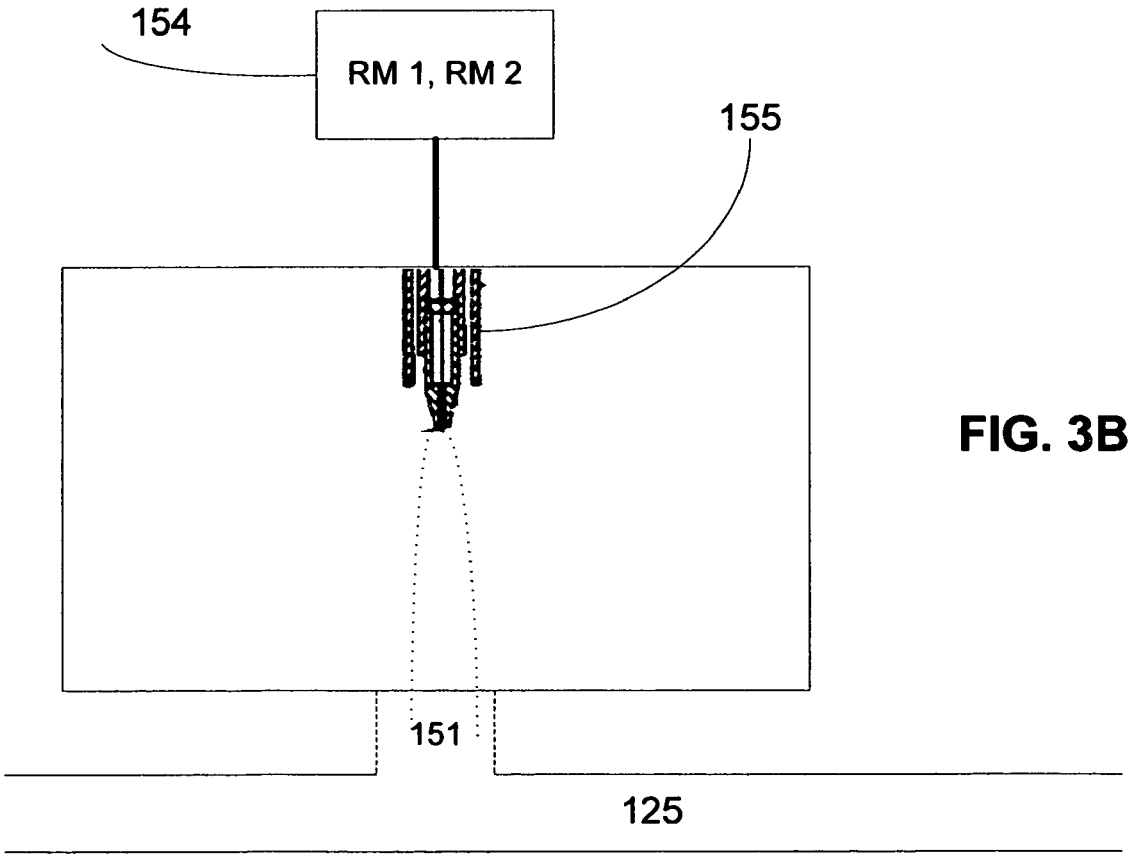
FIG. 3B illustrates an embodiment of the reference mass ion source according to FIG. 3A in which reference masses are introduced into the reference mass ion source chamber via an electrospray ionizer.

FIG. 3A illustrates a second example embodiment of a reference ion mass source according to the present invention which includes a single external reference mass source 154, in this case implemented as a bubbler as in FIGS. 2B and 2C. FIG. 3B illustrates an embodiment in which two groups of reference masses RM 1, RM 2 are mixed in external reference mass source 154, which is coupled via a single effluent line to an electrospray nebulizer ionization device 155. In this case the reference mass compounds may be supplied in liquid solution from the external reference mass source 154 to the nebulizer 155; the nebulizer 155 converts the effluent liquid solution into a charged aerosol. The reference mass ions generated may be directed by electrostatic forces and/or gaseous flow toward the outlet of the chamber into the capillary 125. In embodiments employing other ionization mechanisms, it may be advantageous for the reference mass to be supplied in gaseous form to the chamber 150.

Figure 3C:
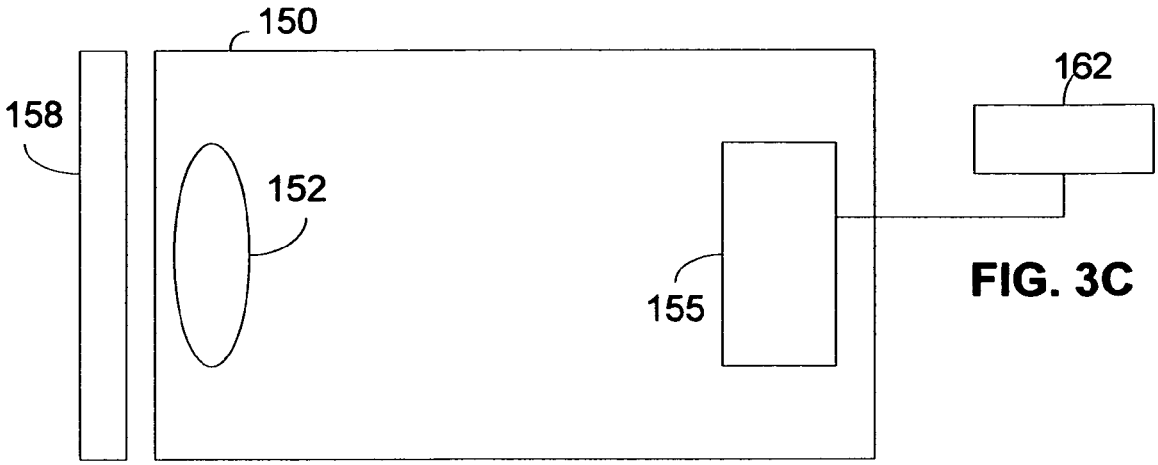
FIG. 3C illustrates an alternative embodiment of a reference mass ion source according to the present invention in which a single source of reference masses is situated internally within the reference mass ion source chamber.

Conversely, in the embodiment of FIG. 3C, there is a single internal reference mass source 152, in this case implemented as a vaporizable solid sample exposed to a heater 158 which causes vaporization of the reference mass sample. In general, any suitable ionization device, such as an APCI corona needle or photoionization source may be used in this context to ionize the reference mass compounds that emanate from the reference mass sources in the embodiments of FIG. 3B and FIG. 3C.

Figure 4A:
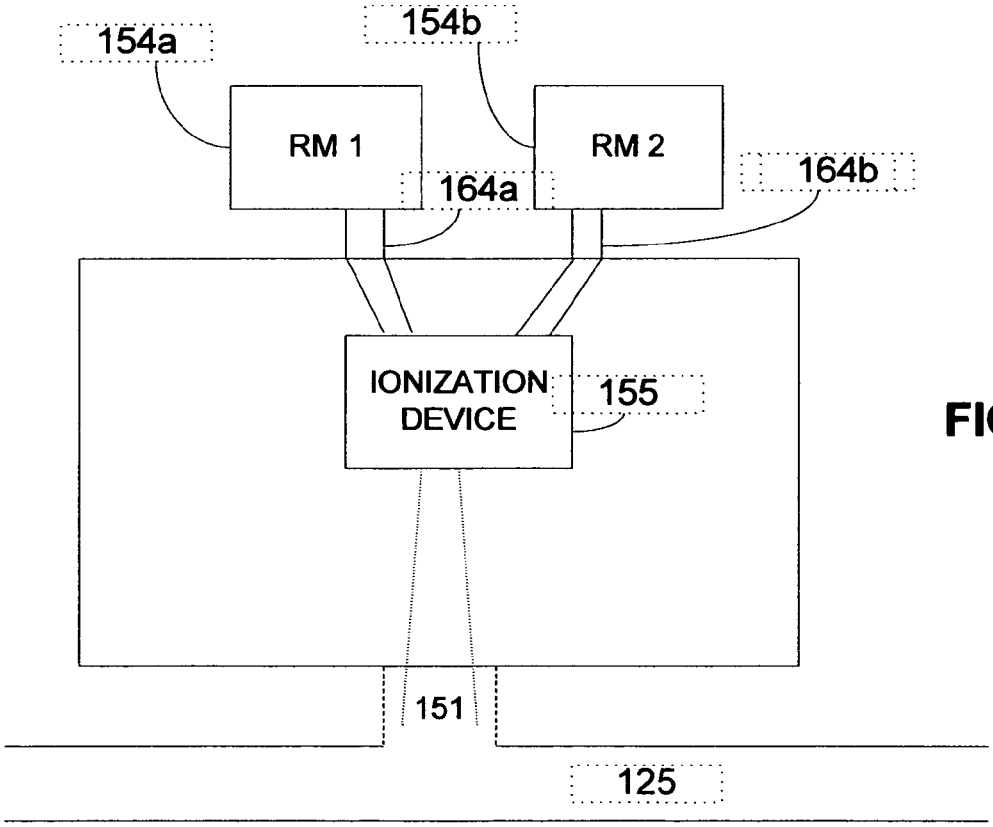
FIG. 4A illustrates an embodiment of a reference mass ion source according to the present invention in which multiple sources of reference masses are situated externally with respect to the reference mass ion source chamber.

FIG. 4A shows an alternative embodiment of the reference mass ion source according to the present invention in which a plurality of sources of reference mass compounds are located externally to the reference mass ion source chamber 150. As shown, a first external reference mass source 154*a* includes reference masses RM 1, and a second external reference mass source 154*b* includes reference masses RM 2. In this case the reference mass ion source chamber 150 may include a single inlet for input of the reference mass compounds RM 1, RM 2, or it may include a plurality of inlets 164*a*, 164*b* (as shown) for this purpose. This embodiment may be particularly advantageous in the case where it is more convenient to couple a plurality of external reference mass source via connectors, valves, tubing, etc., to the reference mass ion source chamber 150. In this manner, the preparation and storage of the reference mass compounds may be performed independently similarly to the embodiment of FIG. 3B. The reference mass compounds RM 1, RM 2 may be introduced into the reference mass ion source chamber via the inlets 164*a*, 164*b* as a fluid stream or gas. Any suitable ionization mechanism can be used, including electrospray, photoionization and APCI.

Figure 5A:
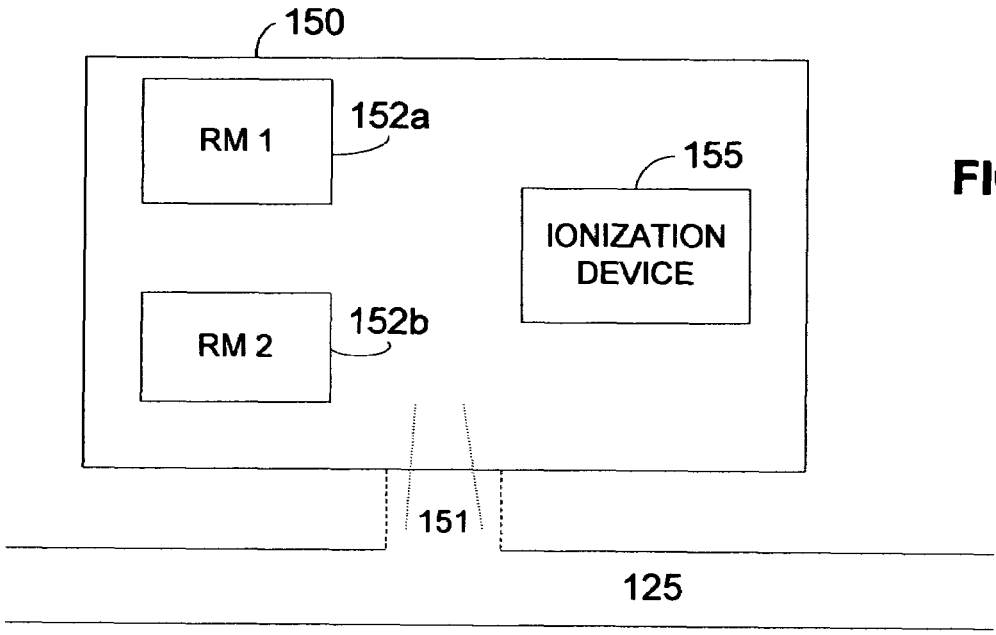
FIG. 5A illustrates an embodiment of a reference mass ion source according to the present invention in which multiple sources of reference masses are situated internally within the reference mass ion source chamber.

In the embodiment shown in FIG. 5A, both reference mass sources 152*a*, 152*b* are situated within the reference mass source chamber 150. In this case the reference mass source may be provided within the chamber in the form of a liquid, a solid or a crystalline matrix. In a particular implementation, separate heaters 158*a*, 158*b* may be provided to vaporize each reference mass compound independently, which may have similar or differing vaporization temperatures. Using reference masses RM 1, RM 2 with distinct vaporization temperatures, the operator may be able control whether to introduce one or both of the reference mass ions into the capillary 125 and also the concentration of the different reference mass ions depending on the amount of heat provided for vaporizing the reference masses.

Figure 5B:
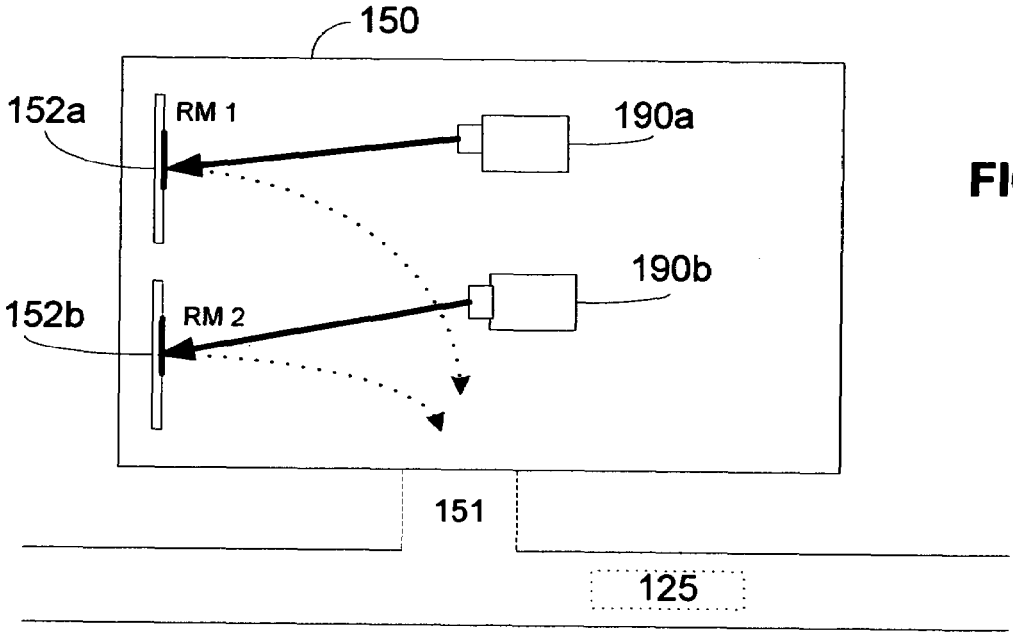
FIG. 5B illustrates an embodiment of the reference mass ion source according to FIG. 5A in which a matrix assisted laser desorption ionization (MALDI) device is situated within the reference mass ion source chamber to ionize reference masses embedded in one or more matrices.

FIG. 5B shows an advantageous implementation of the reference mass ion source according to FIG. 5A in which MALDI laser sources 190*a*, 190*b* are used to "desorb" reference mass ions from their respective solid matrices RM 1, RM 2. In this case, lasers are directed onto sample plates having crystalline matrices 152*a*, 152*b* including respective reference masses RM 1 and RM 2. The laser vaporizes target areas on the matrix, ionizes portions of the matrix, and portion of the reference mass compounds RM 1, RM 2 are thereafter ionized by the matrix ions by a process of charge transfer. It is noted, that a single sample plate may be used having a plurality of reference masses RM 1, RM 2, etc. located at specific sample areas on the sample plate. In this case a single laser may be used that may be selectively directed at areas to release and induce the ionization of particular reference masses.

Having described the present invention with regard to specific embodiments, it is to be understood that the description is not meant to be limiting since further modifications and variations may be apparent or may suggest themselves to those skilled in the art. It is intended that the present invention cover all such modifications and variations as fall within the scope of the appended claims.

What is claimed is:

1. A mass calibration apparatus for an analyte ion source comprising:

a capillary coupled to the analyte ion source at a first point; and a reference mass ion source coupled to the capillary at a second point, downstream from the first point, wherein the reference mass ion source further comprises:

a chamber;

a source of a plurality of reference mass compounds situated externally from and coupled to the chamber; and an ionization device situated in the chamber.

2. The mass calibration apparatus of claim 1, wherein the reference mass ion source is maintained at a pressure sufficient to propel reference mass ions out of the reference mass ion source into the capillary at the second point.

3. The mass calibration apparatus of claim 1, wherein the reference mass ion source is coupled to the capillary via a tee junction.

4. The mass calibration apparatus of claim 3, further comprising:

a voltage source coupled to the tee in the capillary to select a polarity of ions.

5. The mass calibration apparatus of claim 1, wherein the first reference mass compounds are provided in a liquid state.

6. The mass calibration apparatus of claim 1, wherein the ionization device comprises a corona discharge.

7. The mass calibration apparatus of claim 1, wherein the ionization device comprises an ultraviolet (UV) photon source.

8. The mass calibration apparatus of claim 7, wherein the ultraviolet photon source comprises a vacuum ultraviolet (VUV) photon source.

9. The mass calibration apparatus of claim 1, wherein the ionization device comprises a MALDI (Matrix-Assisted Laser Desorption Ionization) unit.

10. The mass calibration apparatus of claim 1, wherein the capillary comprises a conductor.

11. The mass calibration apparatus of claim 1, wherein the capillary comprises a dielectric.

12. A method of mass calibration of analyte ions with reference mass ions in a mass spectrometer that includes an ion source, a mass analyzer, and a capillary coupling the ion source and the mass analyzer, said method comprising:

ionizing reference mass ions in a chamber separate from the ion source and coupled to the capillary; and introducing reference mass ions into the capillary at a junction of the capillary situated between the ion source and the mass analyzer.

13. The method of claim 12, wherein the step of ionizing reference mass ions in a chamber includes:

vaporizing reference mass compounds into a gaseous state; and ionizing the gaseous reference mass compounds using one of the following:

a corona discharge; and a vacuum ultraviolet (VUV) photon source.

14. An ion source for a mass spectrometer comprising:

an analyte ion source chamber having a first output for delivery of analyte ions;

a capillary having first, second and third points, the first point being upstream of the second point, and the second point being upstream of the third point, the capillary being coupled to the output of the analyte ion source chamber at the first point; and a reference mass ion source having a second output for delivery of reference mass ions coupled to the capillary at the second point, wherein the reference mass ion source further comprises:

a reference mass ion source chamber;

a source of a plurality of reference mass compounds situated externally from and coupled to the reference mass ion source chamber; and an ionization device situated in the reference mass ion source chamber;

wherein the analyte ions and reference mass ions are joined in the capillary downstream from the second point for output at the third point.

15. A mass spectrometer comprising:

a) a calibrated ion source, the ion source comprising: a capillary; an analyte ion source coupled to the capillary at a first point along the capillary; and a reference mass ion source coupled to the capillary at a second point, downstream from the first point, wherein the reference mass ion source further comprises:

a chamber;

a source of a plurality of reference mass compounds situated externally from and coupled to the chamber; and an ionization device situated in the chamber;

b) a mass analyzer coupled to the capillary at a third point downstream from the second point; and c) a detector situated downstream from and coupled to the mass analyzer.

16. The mass spectrometer of claim 15, wherein the mass analyzer is selected from the group of: a TOF (Time-Of-Flight) mass analyzer, an ion trap mass analyzer, a quadrupole mass analyzer, an FT-ICR (Fourier Transform-Ion Cyclotron Resonance) mass analyzer, an orbitrap mass analyzer, and a tandem mass spectrometer.

* * * * *